US010273609B2

(12) United States Patent
Kirth et al.

(10) Patent No.: US 10,273,609 B2
(45) Date of Patent: Apr. 30, 2019

(54) PAPER GUIDE ROPE

(71) Applicant: TEUFELBERGER GESELLSCHAFT M.B.H., Wels (AT)

(72) Inventors: Rudolf Kirth, Vocklabruck (AT); Klaus Kronlachner, Krenglbach (AT); Alfred Pirklbauer, Marchtrenk (AT); Susanna Schiemer, Linz (AT)

(73) Assignee: TEUFELBERGER GESELLSCHAFT M.B.H., Wels (AT)

( * ) Notice: Subject to any disclaimer, the term of this patent is extended or adjusted under 35 U.S.C. 154(b) by 139 days.

(21) Appl. No.: 14/833,756

(22) Filed: Aug. 24, 2015

(65) Prior Publication Data

US 2015/0361604 A1 Dec. 17, 2015

Related U.S. Application Data

(63) Continuation of application No. 13/878,079, filed as application No. PCT/EP2011/067270 on Oct. 4, 2011, now abandoned.

(30) Foreign Application Priority Data

Oct. 7, 2010 (AT) ..... 1675/2010

(51) Int. Cl.

| | |
|---|---|
| ***D04C 1/12*** | (2006.01) |
| ***D07B 1/02*** | (2006.01) |
| ***D21G 9/00*** | (2006.01) |

(52) U.S. Cl.

CPC ..... *D04C 1/12* (2013.01); *D07B 1/02* (2013.01); *D21G 9/0072* (2013.01); *D07B 2201/1096* (2013.01); *D07B 2201/2025* (2013.01)

(58) Field of Classification Search

CPC .... D04C 1/12; D07B 1/02; D07B 2201/1096; D21G 9/0072

See application file for complete search history.

(56) References Cited

U.S. PATENT DOCUMENTS

| | | | |
|---|---|---|---|
| 3,805,667 | A | 4/1974 | Orser |
| 3,960,050 | A | 6/1976 | Eisler |
| 4,878,343 | A | 11/1989 | Weidenhaupt et al. |
| 5,901,632 | A | 5/1999 | Ryan |

(Continued)

FOREIGN PATENT DOCUMENTS

| | | | |
|---|---|---|---|
| AT | 503289 | B1 | 9/2007 |
| CN | 2887941 | Y | 4/2007 |

(Continued)

OTHER PUBLICATIONS

U.S. Appl. No. 13/878,079, filed Jun. 25, 2013, Paper Guide Rope.

(Continued)

*Primary Examiner* — Shaun R Hurley

(74) *Attorney, Agent, or Firm* — Womble Bond Dickinson (US) LLP; John J. Penny, Jr.

(57) ABSTRACT

The invention relates to a paper guide rope braided from a plurality of textile subunits, wherein each subunit contains a plurality of twisted yarns made from multifilament yarn. The rope according to the invention is characterized in that the titre of at least part of the twisted yarns, preferably of all the twisted yarns, is in each case at most 5000 dtex, and that the twist rate of at least part of the twisted yarns, preferably of all the twisted yarns, is in each case at least 150 T/m.

14 Claims, 1 Drawing Sheet

(56) References Cited

U.S. PATENT DOCUMENTS

| | | | |
|---|---|---|---|
| 5,931,076 | A | 8/1999 | Ryan |
| 5,934,168 | A | 8/1999 | Feichtinger et al. |
| 6,945,153 | B2 | 9/2005 | Knudsen et al. |
| 7,165,485 | B2 | 1/2007 | Smeets et al. |
| 7,228,777 | B2 | 6/2007 | Morissette et al. |
| 7,703,371 | B2 | 4/2010 | Morissette et al. |
| 2004/0108037 | A1 | 6/2004 | Osborne et al. |
| 2005/0204909 | A1 | 9/2005 | Morissette et al. |
| 2005/0229770 | A1 | 10/2005 | Smeets et al. |
| 2010/0258334 | A1 | 10/2010 | Akaike et al. |
| 2013/0263724 | A1 | 10/2013 | Kirth et al. |

FOREIGN PATENT DOCUMENTS

| | | | |
|---|---|---|---|
| CZ | 19446 | U1 | 4/2009 |
| EP | 0 150 702 | A2 | 8/1985 |
| EP | 0 303 381 | A1 | 2/1989 |
| EP | 0 808 943 | A1 | 11/1997 |
| WO | 2005/021863 | A1 | 3/2005 |
| WO | 2006/55995 | A1 | 6/2006 |

OTHER PUBLICATIONS

**International Search Report dated Apr. 2, 2012 for Application No. PCT/EP2011/067270 (14 pages).

**International Preliminary Report on Patentability dated Apr. 18, 2013 for Application PCT/EP2011/067270 (10 pages).

**Karrer, R., The perfect dynamic rope, production and use. Section 2.2 Twisting. Club Alpino Italiano, 2010. Retrieved from <http://www.caimateriali.org/?id=37>.

**McKenna et al., Handbook of fibre rope technology, rope constructions, laid ropes, braided ropes, production of braided ropes. Fibre Rope Technology. Woodhead Publishing Ltd., England, Jan. 1, 2004, pp. 11-12;81-95;200-211.

PAPER GUIDE ROPE

The present application is a continuation application of U.S. patent application Ser. No. 13/878,079, filed on Jun. 25, 2013. Priority is claimed under 35 U.S.C. § 119 to Austrian Application No. 1675/2010, filed on Oct. 7, 2010, and under 35 U.S.C. § 365 to PCT/EP2011/067270, filed on Oct. 4, 2011, which is hereby incorporated by reference in its entirety.

The present invention relates to a paper guide rope which is braided from a plurality of textile subunits.

Paper guide ropes serve for guiding the paper web, which is being generated, through the roller system in the various sections (e.g., dryer section, size presses, take-up stand) of the paper-making machine. For this purpose, two or three paper guide ropes normally run closely next to each other, and the so-called paper tip is clamped between those ropes and is thus guided through the sections in a controlled manner. The paper guide ropes are circulated, i.e., the ends of a rope are spliced into each other so that a rope ring emerges the length of which depends on the section of the paper-making machine, but usually has an order of magnitude from 50 to 100 m.

Paper guide ropes typically have a diameter ranging from 6 to 17 mm. Their fundamental properties result from the application: the adhesion or clamping force, respectively, between the rope and the paper must be strong enough for the feeding of the paper tip to be possible. Because of the length of the rope ring, the elongation of the rope must not be high. The breaking resistances play a minor part, the lifetime under the unfavourable conditions of a paper-making machine is crucial, however.

The lifetime of paper guide ropes in paper-making machines is limited. Depending on the section (i.e., the application site) in the paper-making machine, the lifetime of a rope is longer or shorter. The ropes are exposed to various influences such as heat, moisture, chemicals and in particular abrasion locations. Particularly problematic sections are the size presses, where chemicals deposit on the rope pulleys and the paper guide ropes come into contact with incrustations forming in this way, hence are exposed to a particularly strong abrasion.

There have already been different approaches to prolong the lifetime of paper guide ropes via their construction.

In EP 0 150 702 A, a so-called "reinforcement" of the rope with monofilaments is suggested. A "reinforcement" is understood to be a wrapping, braiding, knitting etc. around the rope or the fibre material used for manufacturing the rope or subunits of the rope, respectively, which have been made of said fibre material, with the surface of the fibre material, the rope or the subunit, respectively, not being covered completely, however.

In WO 06/55995 A as well as in AT 503.289 B, further details of reinforcements for paper guide ropes are described.

From US 2005/0204909, paper guide ropes are known in which, at first, a monofilament is twisted around a twisted multifilament yarn, i.e., a reinforcement is produced on the twisted multifilament yarn. The reinforced twisted multifilament yarn is then braided into small ropes from which, in turn, the paper guide rope is braided. Alternatively, US 2005/0204909 describes the manufacture of a rope in which the reinforcement (the circumferential twisting with a monofilament) is not attached to the original twisted multifilament yarn, but to the small ropes which have been braided from said twisted yarn.

All those suggestions have in common that a reinforcement is applied to the rope or to one of its elements (the original twisted yarn, a subunit produced from the twisted yarn such as a small rope).

Monofilaments used for the production of reinforcements have the characteristic of breaking soon during use and of rendering the rope shabby. Apparently, the rope looks worn, although it absolutely could still have a long lifetime. However, in paper-making machines, the ropes are normally assessed for their appearance, and a replacement is decided upon according to their appearance.

A further important characteristic of paper guide ropes is their elongation. During their use, the ropes have to be tensed and must remain so. If a paper guide rope stretches, this change of length is compensated for by means of a tension station so that the tension of the rope remains the same. Normally, the tension path of the tension station is limited, however. Thus, an elongation of the rope which is too strong will have the effect that it can no longer be tensed, will thus be exposed to increased wear and may also bounce out of its track and must therefore be replaced. Known ropes comprising a reinforcement made of monofilaments exhibit a comparatively high elongation, which is caused by the construction.

From CZ 19446 U1, a rope is known which is braided from a plurality of textile subunits, each consisting of yams which merely lie next to each other. The yarns are thereby not twisted. As a result, a rope with comparatively little elongation is formed.

It is the object of the present invention to provide a paper guide rope which has a substantially higher abrasion resistance than conventional paper guide ropes and, at the same time, an elongation which is sufficiently minor. In particular, the paper guide rope should not comprise a reinforcement for the above-described reasons.

Said object is achieved by means of a paper guide rope braided from a plurality of textile subunits, wherein each subunit contains a plurality of twisted yarns made from multifilament yarn, and which is characterized in that the titre of at least part of the twisted yarns, preferably of all the twisted yarns, is in each case at most 5000 dtex, and that the twist rate of at least part of the twisted yarns, preferably of all the twisted yarns, is in each case at least 150 T/m.

SHORT DESCRIPTION OF THE FIGURES

DETAILED DESCRIPTION OF THE INVENTION

Figure 1:
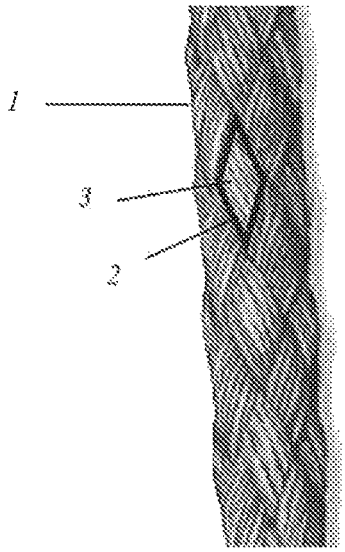
FIG. 1 shows an embodiment of a braided paper guide rope.

It has been found that paper guide ropes the textile subunits of which are not made up of thick twisted yarns (having a thickness of, e.g., 8400 dtex per twisted yarn) with a relatively low twist rate (typically about 80 T/m), but of relatively thin twisted yarns with a very high twist rate, exhibit excellent properties in terms of abrasion resistance, with the elongation properties being good at the same time.

With the rope according to the invention, there is no necessity in particular to provide an additional reinforcement so that, according to a preferred embodiment of the present invention, neither the rope nor the subunits or their twisted yams, respectively, comprise a reinforcement.

The twist rate of the twisted yarns in the rope according to the invention may in each case be 150 T/m to 350 T/m, preferably 150 T/m to 250 T/m, particularly preferably 200 T/m.

The titre of the twisted yarns in the rope according to the invention may in each case be 400 dtex to 5000 dtex, preferably 2500 dtex to 4500 dtex, particularly preferably 4200 dtex.

Any suitable textile multifilament yarn may be used as a fibre material for manufacturing the twisted yarns. In particular, at least part of the twisted yarns may consist of polyamide multifilament yarn. However, yarn mixtures may also be provided. For example, a twisted yarn with 3 strands can be composed of one yarn of polyamide and two yarns of a different material, for example, polyester.

Optionally, the multifilament yarns and, respectively, the twisted yarns produced therefrom can be impregnated and/or thermoset in a manner known per se. Also the entire rope can be impregnated and/or thermoset in a manner known per se.

The number of twisted yarns per subunit is preferably at least 7, particularly preferably 9 to 16.

For the purposes of the present invention, the term "subunit" is understood to mean accumulations of fibre material which end up lying in parallel and next to each other in the rope, such as, e.g., a plurality of twisted yarns lying next to each other, twisted yarns which have been braided or twisted yarns which have been twisted around each other.

Figure 2:
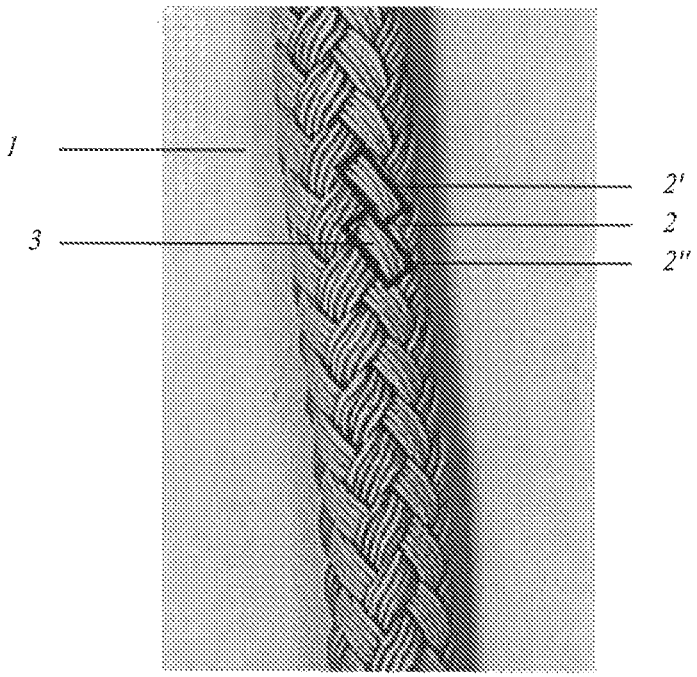
FIG. 2 shows a further embodiment of a braided paper guide rope.

In order to demonstrate the term "subunit", FIGS. 1 and 2 show two different embodiments of a paper guide rope 1.

In the embodiment according to FIG. 1, the rope 1 is composed of subunits 2 (herein: braided rhombi) which, in each case, contain more than seven twisted yarns 3. Said subunits 2 can be produced, in each case, by means of two bobbins operating one after the other, with the shape of a braided rhombus resulting therefrom (framed in FIG. 1). In the subunits, the twisted yarns lie essentially in parallel next to each other.

In the embodiment according to FIG. 2, the rope 1 is likewise composed of subunits 2, which, in each case, are produced by means of two bobbins. The result is, in each case, two elements 2', 2" (framed in FIG. 2), which lie next to each other at least partly. The subunit 2 made up of the sections lying next to each other of the two elements 2', 2" again comprises at least seven twisted yarns. Also in this embodiment, the twisted yarns lie essentially next to each other in the subunits 2 or in their elements 2', 2", respectively.

Correspondingly, this definition of the subunit is applicable also to embodiments which are formed by more than two bobbins operating one after the other in the two machine directions S and Z. However, today, such a rope structure is not intended for current braiding machines.

The paper guide rope according to the invention may be provided in the form of a hollow rope or also in the form of a rope with a core.

EXAMPLES

The following four ropes were produced:

1) A rope according to the invention:

A twisted yarn made of PA6 multifilament: 1400 dtex x3 200T/m (in S-direction and Z-direction, respectively)

This twisted yarn is impregnated.

Construction of the rope: braided on a braiding machine with 16 bobbins with the following equipment:

S-direction: 8 bobbins, each with 5 S-twisted yarns

Z-direction: 4 bobbins, each with 5 Z-twisted yarns, and 4 bobbins, each with 4 Z-twisted yarns Hence, the subunit in the S-direction consists of 10 twisted yarns.

Hence, the subunit in the Z-direction consists of 9 twisted yarns.

2) A paper guide rope of conventional design with a reduced twist rate of the twisted yarn:

A twisted yarn made of PA6 multifilament: 1400 dtex x6 20T/m (in S-direction and Z-direction, respectively)

This twisted yarn is impregnated.

Construction of the rope: braided on a braiding machine with 16 bobbins with the following equipment:

S-direction: 8 bobbins, each with 2 S-twisted yarns

Z-direction: 6 bobbins, each with 3 Z-twisted yarns, and 2 bobbins, each with 2 Z-twisted yarns 3) A paper guide rope of conventional design (with normal twist rate of the twisted yarn):

A twisted yarn made of PA6 multifilament: 1400 dtex x6 80T/m (in S-direction and Z-direction, respectively)

This twisted yarn is impregnated.

Construction of the rope: braided on a braiding machine with 16 bobbins with the following equipment:

S-direction: 8 bobbins, each with 2 S-twisted yarns

Z-direction: 4 bobbins, each with 3 Z-twisted yarns, and 4 bobbins, each with 2 Z-twisted yarns 4) A rope with a monofilament reinforcement Construction of the rope: braided on a braiding machine with 16 bobbins with the following equipment:

S-direction: 8 bobbins, each with 1 S-element

Z-direction: 8 bobbins, each with 1 Z-element

S-element: 2 S-twisted yarns (PA6 multifilament 1400 dtex x6 80T/m) around which 16 PA-monofilaments (diameter 0.2 mm) have been braided Z-element: 2 Z-twisted yarns (PA6 multifilament 1400 dtex x6 80T/m) around which 16 PA-monofilaments (diameter 0.2 mm) have been braided Measuring method of dry elongation:

At a load of 1 kg, 1 m of rope is marked. Then, a load of 80 kg is applied, the load is kept for 5 min, and subsequently the elongation is read off. Elongation in cm =elongation in %

Measuring method of wet elongation:

Similar to dry elongation, but after the marking of lm of rope, the rope is placed for 5 min in water, which is cold at 25° C.

The elongation values measured in the above ropes 1) to 4) are illustrated in the following table:

| | Dry elongation % | Wet elongation % |
|---|---|---|
| Rope 1) (according to the invention) | 2.4 | 4.4 |
| Rope 2) | 1.8 | 3.5 |
| Rope 3) | 1.9 | 3.5 |
| Rope 4) | 2.8 | 4.5 |

Data regarding lifetime and abrasion resistance:

The measure of the lifetime is the residual breaking load in [%] after a simulated run in a wet section of a paper-making machine. For this purpose, a test unit consisting of 10 pulleys was developed. The rope circulates with 800 m/min and is thereby sprayed with water (consumption: 1.6 l/h). The rope is operated at a tension of 30 kg, and, for achieving an additional abrasion effect, some of the rope pulleys are not aligned—i.e., the rope runs slightly over the rope pulley flank.

The residual strength of the ropes 1) to 4) after 24 h of this experiment is indicated in the following table:

| | 24 h residual strength % |
|---|---|
| Rope 1) (according to the invention) | 56.7 |
| Rope 2) | 24.3 |
| Rope 3) | 49.2 |
| Rope 4) | 39.5 |

It is clearly evident that the rope according to the invention exhibits an improved residual strength, with the elongation properties being satisfactory at the same time. An optical assessment of the rope indicates a satisfactory appearance, while, for example, rope 3 shows clearly visible stress marks.

The invention claimed is:

1. A paper guide rope braided from a plurality of textile subunits, wherein each subunit contains a plurality of twisted yarns made from multifilament yarn, characterized in that the titre of each yarn in at least part of the twisted yarns is at most 5000 dtex, and that the twist rate of each yarn in at least part of the twisted yarns is 200 T/m.

2. A paper guide rope according to claim 1, characterized in that the rope, the subunits and the twisted yarns have no reinforcement.

3. A paper guide rope according to claim 1, characterized in that the titre of each yarn in the twisted yarns is 400 dtex to 5000 dtex.

4. A paper guide rope according to claim 1, characterized in that the diameter of the rope ranges from 6 to 17 mm.

5. A paper guide rope according to claim 1, characterized in that the textile material of at least part of the twisted yarns consists of polyamide.

6. A paper guide rope according to claim 1, characterized in that the number of twisted yarns per subunit is at least 7.

7. A paper guide rope according to claim 1, wherein the titre of each yarn in all of the twisted yarns is at most 5000 dtex, and the twist rate of each yarn in all of the twisted yarns is at least 150 T/m.

8. A paper guide rope according to claim 1, wherein the twist rate of each yarn in the twisted yarns is 150 T/m to 250 T/m.

9. A paper guide rope according to claim 3, wherein the titre of each yarn in the twisted yarns is 2500 dtex to 4500 dtex.

10. A paper guide rope according to claim 3, wherein the titre of each yarn in the twisted yarns is 4200 dtex.

11. A paper guide rope according to claim 4, wherein the diameter of the rope is 8 to 13 mm.

12. A paper guide rope according to claim 6, wherein the number of twisted yarns per subunit is 9 to 16.

13. A paper guide rope braided from a plurality of textile subunits, wherein each subunit contains a plurality of twisted yarns made from multifilament yarn, characterized in that the titre of each yarn in at least part of the twisted yarns is at most 5000 dtex, and that the twist rate of each yarn in at least part of the twisted yarns is at least 200 T/m.

14. A paper guide rope according to claim 13, characterized in that the twist rate of each yarn in the twisted yarns is 200 T/m to 350 T/m.

* * * * *